US007185847B1

(12) United States Patent
Bouchard et al.

(10) Patent No.: US 7,185,847 B1
(45) Date of Patent: Mar. 6, 2007

(54) WINGED VEHICLE WITH VARIABLE-SWEEP CANTILEVERED WING MOUNTED ON A TRANSLATING WING-SUPPORT BODY

(75) Inventors: Mark L. Bouchard, Tucson, AZ (US); Purna Gogineni, Tucson, AZ (US); Rudolph A. Eisentraut, Tucson, AZ (US); Juan A. Perez, Tucson, AZ (US); Kevin Greenwood, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 66 days.

(21) Appl. No.: 10/845,700

(22) Filed: May 13, 2004

(51) Int. Cl.
*B64C 3/40* (2006.01)

(52) U.S. Cl. ..... 244/46; 244/3.28

(58) Field of Classification Search ..... 244/46, 244/218, 3.27–3.29
See application file for complete search history.

(56) References Cited

U.S. PATENT DOCUMENTS

| | | | | | |
|---|---|---|---|---|---|
| 2,074,897 | A | * | 3/1937 | Everts | 244/46 |
| 2,683,574 | A | * | 7/1954 | Peterson | 244/46 |
| 3,206,146 | A | * | 9/1965 | Toms | 244/46 |
| 3,212,732 | A | * | 10/1965 | Scerbo et al. | 244/46 |
| 3,381,918 | A | * | 5/1968 | Jacquart et al. | 244/46 |
| 3,405,891 | A | * | 10/1968 | Jacquart et al. | 244/218 |
| 4,139,171 | A | | 2/1979 | Harris | |
| 5,035,378 | A | | 7/1991 | Spanovich | |
| 5,141,175 | A | | 8/1992 | Harris | |
| 5,615,846 | A | | 4/1997 | Shmoldas et al. | |
| 5,671,899 | A | | 9/1997 | Nicholas et al. | |
| 5,899,410 | A | | 5/1999 | Garrett | |
| 5,915,650 | A | | 6/1999 | Petrovich | |
| 6,152,041 | A | | 11/2000 | Harris et al. | |

* cited by examiner

*Primary Examiner*—Galen Barefoot
(74) *Attorney, Agent, or Firm*—Thomas J. Finn; Leonard A. Alkov; Karl A. Vick

(57) ABSTRACT

A winged vehicle includes an elongated fuselage, and a wing mechanism affixed to the fuselage. The wing mechanism has a wing-support-body track affixed to and extending lengthwise along the fuselage, a translating wing-support body engaged to and translatable along the wing-support-body track, and exactly two deployable cantilevered wings. Each deployable cantilevered wing has a wing pivot mounted to the translating wing-support body so that the deployable cantilevered wing is pivotable about the translating wing-support body. The two deployable cantilevered wings are each pivotable between a stowed position and a deployed position. An actuation mechanism is operable to controllably move the translating wing-support body along the wing-support-body track and to controllably move the two deployable cantilevered wings between the stowed position and the deployed position.

20 Claims, 4 Drawing Sheets

WINGED VEHICLE WITH VARIABLE-SWEEP CANTILEVERED WING MOUNTED ON A TRANSLATING WING-SUPPORT BODY

This invention relates to a winged vehicle wherein the wings are initially stowed and then are deployed when the winged vehicle is launched and, more particularly, to the deployment mechanism.

BACKGROUND OF THE INVENTION

Until recently, most bombs were of the unguided, gravity type. The bomb was aimed by the motion of the aircraft on which it was carried and which flew approximately over the target. The bomb was released from a location on the flight path estimated to cause the bomb to fall onto its target. After the bomb was dropped there was no control over its motion. The result was that the aircraft was exposed to defensive measures over the target for an extended period of time in a flight path that was required to be straight and level, and the accuracy of the bombing was always somewhat problematic.

Recent developments improved upon this type of earlier munition in important ways. Wings were affixed to the bomb so that it could be dropped at a distance from the target of many miles and would glide to its target. The bomber aircraft consequently had far less exposure to defensive measures. The glide bomb was also provided with movable control surfaces and a guidance system, typically based upon cooperation with a laser designator, an inertial navigation system, or the global positioning system. The guidance capability greatly improved the accuracy of the bombing and reduced collateral damage.

The flight distance of a glide bomb depends upon several factors, one of which is the length of the wings. Long, slender wings result in long glide distances. However, long, slender wings take up a great deal of space in the bomb deployment racks on the launching aircraft. It has therefore become an established practice to fold the wings to a folded position along the fuselage of the glide bomb for storage, and then to pivot the wings to an open, deployed position when the bomb is dropped.

However, even this approach is not fully satisfactory in that it does not permit optimal-length and optimal-performance wings to be used with many types of bombs. There is accordingly a need for an improved approach to glide bombs and other types of winged weapons such as some types of powered missiles, which further improves their aerodynamic performance. The present invention fulfills this need, and further provides related advantages.

SUMMARY OF THE INVENTION

The present invention provides a winged vehicle in which the wings are initially folded in a stowed position when the winged vehicle is carried on its launcher aircraft, and then are opened to a deployed position when the winged vehicle is separated from the launcher aircraft. The wings are longer than is possible with a conventional pivoting-wing design, improving the flight performance of the winged vehicle.

In accordance with the invention, a winged vehicle includes an elongated fuselage, and a wing mechanism affixed to the fuselage. The wing mechanism has a wing-support-body track affixed to and extending lengthwise along the fuselage, a translating wing-support body engaged to and translatable along the wing-support-body track, and exactly two deployable cantilevered wings. Each deployable cantilevered wing has a wing pivot mounted to the translating wing-support body so that the deployable cantilevered wing is pivotable about the translating wing-support body. The two deployable cantilevered wings are each pivotable between a stowed position and a deployed position. An actuation mechanism is operable to controllably move the translating wing-support body along the wing-support-body track and to controllably move the two deployable cantilevered wings between the stowed position and the deployed position.

Significantly, in the present approach there are exactly two deployable cantilevered wings. That is, both (i.e., all) of the deployable cantilevered wings are mounted to the wing-support body in a cantilevered fashion. There are no struts or other external bracing (sometimes called "aft wings", depending upon their surface area) that deploy along with the deployable primary wings, as in U.S. Pat. No. 5,899,410. Such struts add weight and drag without providing a corresponding benefit in added lift. Additionally, such struts typically do not have their pivot points on the wing-support body, so that their center of lift does not move in the same manner as does the center of lift of the deployable wings.

The actuation mechanism may be of any operable type and may include any operable type of drive. Examples of operable drives include an electromechanical actuator, a pneumatic actuator, a gas actuator, or a spring actuator. There may be one, two, or more individual actuators (also termed drives or drive motors). Typically, there is either one actuator whose operation controls both the linear movement of the wing-support body and, through gearing or other linkage, the pivoting movement of the wings; or two actuators, one driving the linear movement of the wing-support body and the other the pivoting movement of the wings. In one preferred approach using exactly one actuator, the deployable cantilevered wings pivot about their respective wing pivots in mechanical linkage with a movement of the translating wing-support body. This movement may be accomplished, for example, by a leadscrew drive that controllably moves the translating wing-support body, and a gear structure that pivots the deployable cantilevered wings responsive to the movement of the translating wing-support body. Thus, in one form, an actuation mechanism operable to controllably move the translating wing-support body along the wing-support-body track comprises a leadscrew operable between the fuselage and the translating wing-support body, an electromechanical drive motor that turns the leadscrew, and a pivot mechanism whose turning produces a pivoting movement of the deployable cantilevered wings about their respective wing pivots relative to the translating wing-support body.

In another embodiment, the movement of the wing-support body and the deployment of the wings may be separately driven, by two independently operating actuators. In this case, a first drive is stationary and drives the wing-support body, and a second drive is supported on the wing-support body and moves the wings between the stowed and deployed positions.

The winged vehicle may further include an attachment structure that attaches the winged vehicle to a launcher. The winged vehicle may also have a movable guidance surface and a warhead. The winged vehicle may be unpowered or it may have a propulsion system.

In a preferred design, the fuselage has a nose and a tail, and the first position of the wing-support body is closer to the nose than is the second position. That is, as the deployable cantilevered wings deploy, the wing-support body slides rearwardly along the wing-support-body track. When the deployable cantilevered wings are folded to their stowed position, they lie along or near to the fuselage. Because the wing-support body is in its forward-most first position, there is sufficient length along the fuselage for the deployable cantilevered wings to be long yet not extend beyond the tail of the fuselage and not be interfered with by other structure such as the movable guidance surfaces or antennas that may be present. However, it would not be satisfactory for the wing-support body to remain in this forward-most first position when the deployable wings were deployed to their open positions, as the center of aerodynamic lift would be so far forward of the center-of-gravity that the winged vehicle would not be readily flyable in a stable manner. The wing-support body and thence the pivot point of the deployable cantilevered wings is therefore translated rearwardly as the deployable wings deploy, to the second position where the center of gravity and the center of aerodynamic lift are satisfactorily positioned for flight. The result is that the winged vehicle has a greater range due to the longer deployable cantilevered wings, yet is still readily stowed in available weapons bays and on available launchers.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
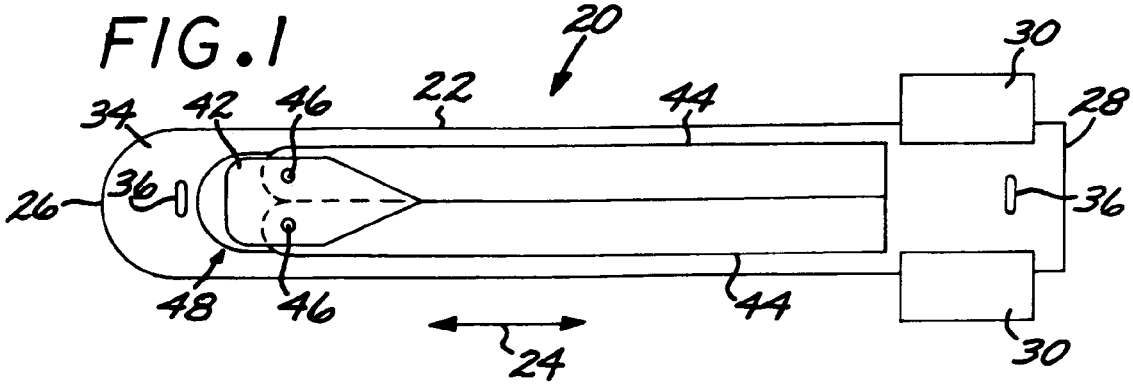
FIG. 1 is a plan view of a winged vehicle with the deployable cantilevered wings in the stowed position.
Figure 2:
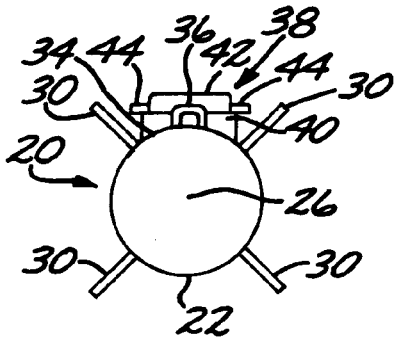
FIG. 2 is a front elevational view of the winged vehicle of FIG. 1
Figure 3:
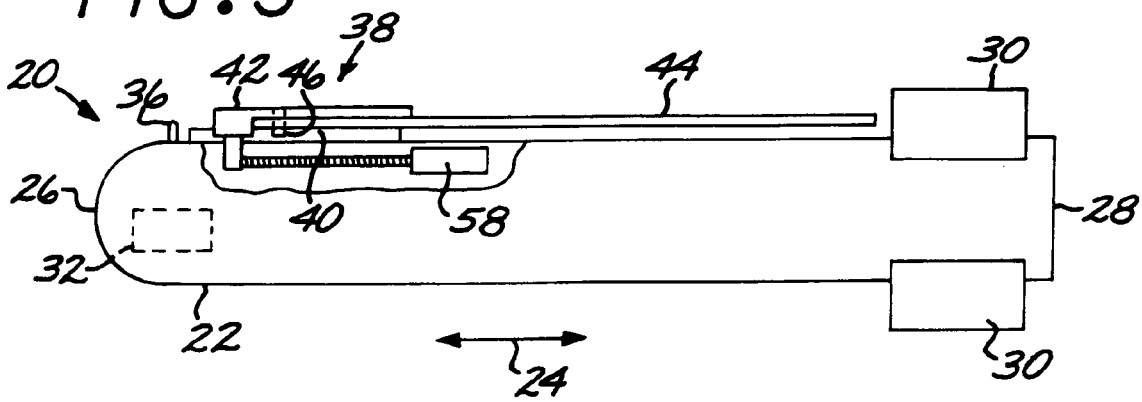
FIG. 3 is a side elevational view of the winged vehicle of FIG. 1, with some features shown in phantom view.

FIGS. 1–4 depict a first embodiment of a winged vehicle 20 having an elongated fuselage 22 with a direction of elongation 24, a nose 26, and a tail 28. Extending from the fuselage 22 at a location near the tail 28 are four optional, but preferably present, movable guidance surfaces 30 extending outwardly from the fuselage. The optional movable guidance surfaces 30 are moved by actuators (not visible in the drawings) inside the fuselage 22 responsive to commands from an optional controller 32 that senses the position of the winged vehicle 20 in relation to its target and guides the winged vehicle 20 toward its target by movements of movements of the guidance surfaces 30. The controller 32 may optionally include other consistent features found in winged vehicles and known in the art, such as radar or infrared seekers, inertial or GPS guidance units, laser guidance units, transceivers, and communications uplinks and downlinks. A warhead (not visible in the drawings) typically occupies a major portion of the interior of the fuselage. The winged vehicle 20 of FIGS. 1–4 is a glide bomb, and has no internal propulsion system. On an upper side 34 of the fuselage 22 is an attachment structure 36 that detachably attaches the winged vehicle 20 to a launcher (not shown) such as an aircraft that carries the winged vehicle 20 prior to launch. In the illustrated embodiment, the attachment structure 36 is a pair of conventional attachment lugs that interface with the launcher, but other attachment structures may be used as well.

A wing mechanism 38 is affixed to the fuselage 22, in this case to the upper side 34 of the fuselage 22. Equivalently for the present purposes, the wing mechanism 38 may be affixed to the lower side of the fuselage or to structure within the fuselage. The wing mechanism 38 includes a wing-support-body track 40 affixed to and extending lengthwise along the fuselage 22 parallel to the direction of elongation 24. A wing-support body 42 is engaged to and translatable along the wing-support-body track 40 in a sliding movement parallel to the direction of elongation 24. A pair of (i.e., exactly two) deployable cantilevered wings 44 are pivotably affixed by respective pivots 46 to the wing-support body 42. As used herein, "cantilever" and "cantilevered" refers to a form of wing construction in which no external bracing is used. That is, each cantilevered wing 44 is supported only from a position near its inboard end, and specifically from the pivots 46. There is no external bracing (which may be variously called a strut or an aft wing or the like) as in the designs described and illustrated in U.S. Pat. No. 5,899,410. Such external bracing is necessary to the deployment mechanism in the '410 patent, but it adds weight and drag without providing a corresponding benefit in added lift. Additionally, pivoting external bracing typically does not have its pivot points on the wing-support body, so that the center of lift does not move in the same manner as it does for the deployable cantilevered wings. The use of the cantilevered-wing design of the present approach provides a significant weight and aerodynamic advantage over externally braced designs.

Figure 4:
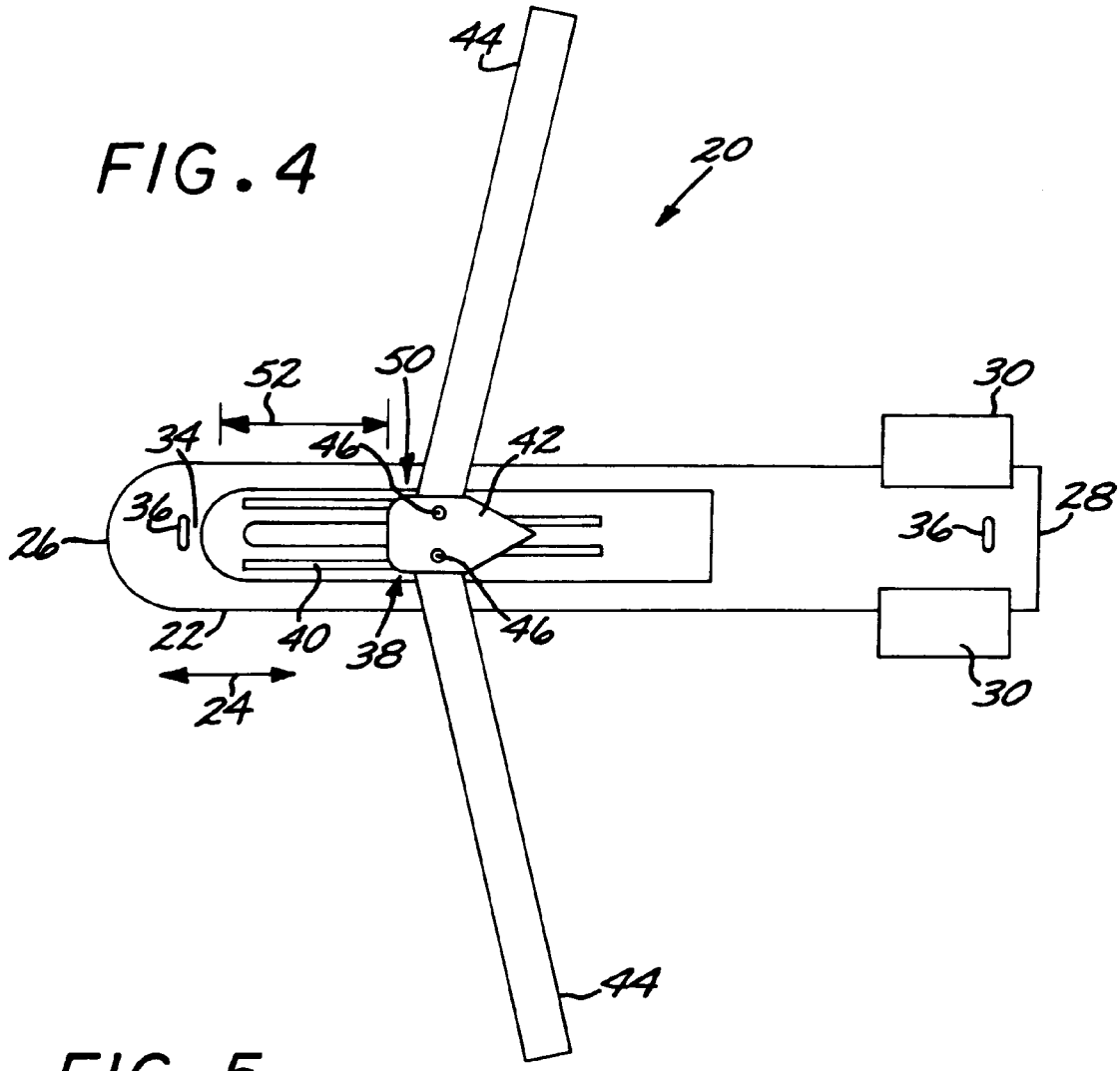
FIG. 4 is a plan view of the winged vehicle of FIG. 1, but with the deployable cantilevered wings in the deployed position.

Each of the deployable cantilevered wings 44 is movable between (1) a stowed position illustrated in FIG. 1 wherein the deployable cantilevered wings 44 lie relatively close to the fuselage 22 when the wing-support body 42 is in a first position 48 along the wing-support-body track 40, and (2) a deployed position illustrated in FIG. 4 wherein the deployable cantilevered wings 44 are deployed to extend relatively outwardly from the fuselage 22 when the wing-support body 42 is in a second position 50 along the wing-support-body track 40. In the illustrated embodiment, the first position 48 is closer to the nose 26 than is the second position 50, so that the wing-support body 42 moves rearwardly as the deployable cantilevered wings 44 deploy from the closed position to the open position. The deployable cantilevered wings 44 preferably move symmetrically relative to the fuselage 22.

The extent of movement between the first position 48 and the second position 50 is indicated by dimension 52 in FIG. 4.

In other embodiments, the deployable cantilevered wings 44 may extend straight outwardly from the fuselage or be forwardly swept in the open position, as distinct from the rearwardly swept deployable cantilevered wings shown in FIG. 4. In yet other embodiments, the wing-support body may move forwardly as the deployable cantilevered wings deploy from the closed to the open position. All of these embodiments are accomplished with changes to the direction and extent of movement of the wing-support body 42.

Figure 5:
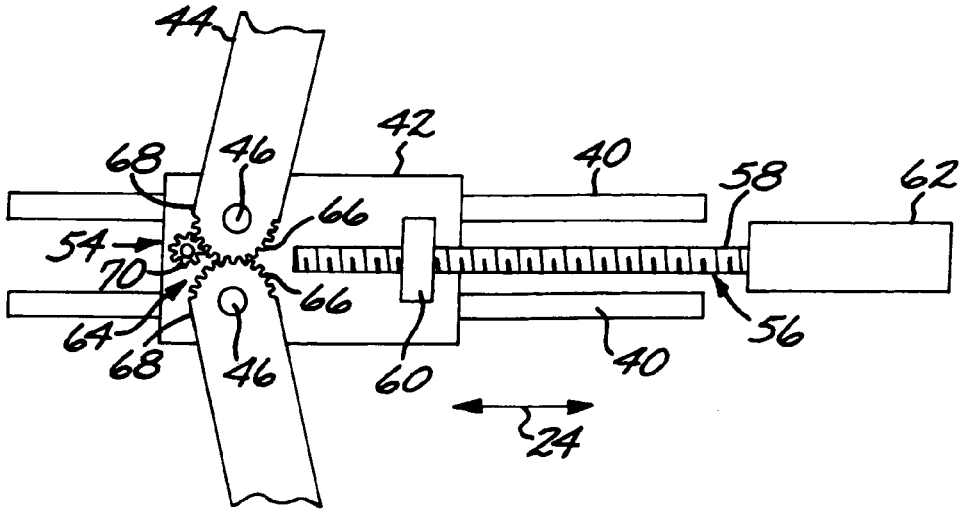
FIG. 5 is a schematic top view of a first embodiment of the actuation mechanism for the translating wing-support body and the deployable cantilevered wings.
Figure 6:
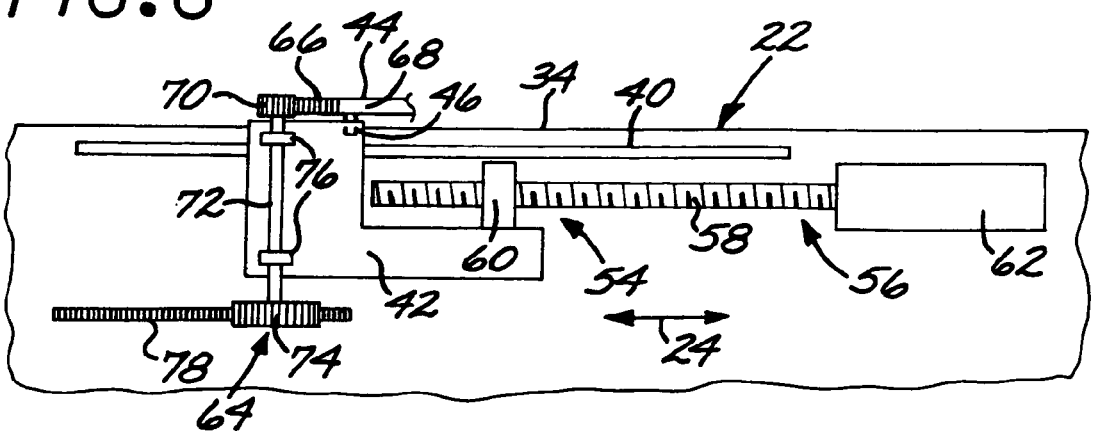
FIG. 6 is a schematic side view of the actuation mechanism of FIG. 5.

An actuation mechanism 54 is operable to move the two deployable cantilevered wings 44 from the stowed position of FIG. 1 to the deployed position of FIG. 4. The actuation mechanism 54 may be of any operable type. FIGS. 5–6 illustrate one preferred form of the actuation mechanism 54. In this actuation mechanism 54, there is a single drive motor that drives the wing-support body 42 along the wing-support-body track 40 parallel to the direction of elongation 24. The deployable cantilevered wings 44 pivot about their respective pivots 46 responsive to and in mechanical linkage with this movement of the wing-support body 42, so that only a single drive motor is required to accomplish both the movement of the wing-support body 42 and the pivoting motion of the cantilevered wings 44. This actuation mechanism 54 allows the cantilevered wings 44 to be controllably deployed by various amounts from a highly swept configuration to a widely extended, low-sweep configuration in which the cantilevered wings 44 each extend at or near 90 degrees to the fuselage 22. The forward-aft position of the wing-support body 42 is appropriately adjusted for the entire range of sweep configurations so that the center of lift stays appropriately positioned relative to the center of gravity of the winged vehicle 20.

More specifically in the design for the actuation mechanism 54 as shown in FIGS. 5–6, a leadscrew drive 56 includes a leadscrew 58 that engages a leadscrew follower 60 fixed to the wing-support body 42, and a single electromechanical drive motor 62 that rotationally drives the leadscrew 58. The leadscrew 58 and the drive motor 62 are both mounted within the fuselage 22 of the winged vehicle 20. As the leadscrew 58 turns, the follower 60 causes the wing-support body 42 to move along the wing-support-body track 40 parallel to the direction of elongation 24 according to the direction of rotation of the leadscrew 58. The deployable cantilevered wings 44 are mounted to the wing-support body 42 by the respective pivots 46 (but no struts), and travel along the direction of elongation 24 as the leadscrew turns 58.

In the embodiment of FIGS. 4–5, the deployable cantilevered wings 44 are pivoted between the folded and deployed positions by a gear structure 64, although other operable deployment mechanisms may be used. In the illustrated embodiment, the gear structure pivots the deployable cantilevered wings 44 responsive to the movement of the wing-support body 42, without the need for a separate drive motor in addition to the drive motor 62. Each of the deployable cantilevered wings 44 has a set of wing teeth 66 along the periphery 68 of a base thereof. The wing teeth 66 of the two deployable cantilevered wings 44 engage each other, so that the pivoting of the two deployable cantilevered wings 44 occurs together in a coordinated fashion, to the same deployment angle (i.e., sweep angle) relative to the direction of elongation 24. A spur gear 70, which serves as a pivot gear, engages the wing teeth 66 of one of the two deployable cantilevered wings 44, so that the turning of the spur gear 70 causes the engaged deployable cantilevered wing 44 to pivot on its pivot 46. The engagement of the wing teeth 66 between that first-driven deployable cantilevered wing 44 and the second deployable cantilevered wing 44 causes that second deployable cantilevered wing to turn on its pivot 46 by an identical amount.

The spur gear 70 is mounted on a shaft 72 to turn with a pinion gear 74. The shaft 72 is mounted with a bearing 76 to the wing-support body 42 and therefore moves with it. The pinion gear 74 engages a rack 78 that is stationary in the fuselage 22 and extends parallel to the axis direction of elongation 24. As the wing-support body 42 moves when driven by the leadscrew drive 56, the engagement between the pinion gear 74 and the rack 78 causes the shaft 72 and thence the spur gear 70 to turn. The turning of the spur gear 70 causes the deployable cantilevered wings 44 to pivot about their respective pivots 46, so as to move toward the folded position or toward the deployed positions, depending upon the direction that the leadscrew 58 turns. The leadscrew 58 is not directly geared to the spur gear 70. Instead, the turning of the leadscrew 58 indirectly causes the spur gear 70 (i.e., the pivot gear) to turn, deploying the cantilevered wings 44.

Other operable types of drives for the actuation mechanism 54 may be used, such as a pneumatic actuator or a gas actuator having a cylinder linked to the wing-support body 42, or a spring actuator. The actuator 58 may accomplish the movement of the deployable cantilevered wings 44 by operating upon any portion of the structure formed between the wing-support body 42 and the deployable cantilevered wings 44.

As may be seen by an inspection of FIG. 4, if the wing-support body 42 were fixed in the second position 50, the ends of the deployable cantilevered wings 44 would contact the movable guidance surfaces 30 as the deployable cantilevered wings 44 folded from the closed toward the open position, or would extend past the tail 28 and possibly interfere with the structure of the launching aircraft or other weapons positioned behind the winged vehicle 20. By positioning the wing-support body 42 in the first position 48 of FIG. 1 when the deployable cantilevered wings 44 are folded and stowed, the deployable cantilevered wings 44 may be made longer than would be otherwise possible and still not interfere with the movable guidance surfaces 30 or extend past the tail 28 in the stowed position, adding to the lift and range of the winged vehicle 20. For this reason, the first position 48 is desirably located as close to the nose 26 as possible, consistent with the other requirements of the winged vehicle 20. When the deployable cantilevered wings 44 deploy and the wing-support body 42 moves to the second position 50 of FIG. 4, the center of the lifting force of the deployable cantilevered wings 44 (i.e., the center of lift) is properly positioned along the length of the winged vehicle 20 for the proper positioning of the aerodynamic forces and the center of gravity of the winged vehicle 20.

Figure 7:
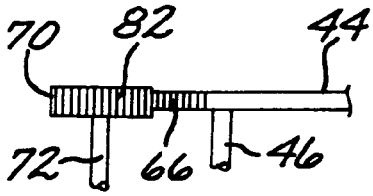
FIG. 7 is a front elevational view of a detail of a first embodiment of the engagement between the spur gear and the wing teeth.
Figure 8:
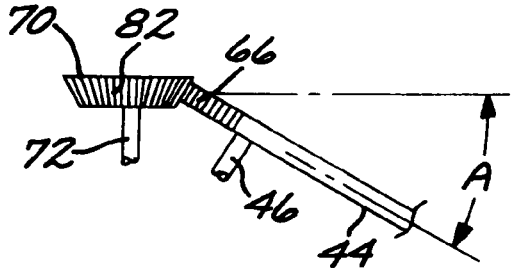
FIG. 8 is a front elevational view of a detail of a second embodiment of the engagement between the spur gear and the wing teeth.

The present drive system for opening the cantilevered wings 44 permits the two cantilevered wings to be coplanar upon opening, as depicted in FIG. 7, or to have a dihedral upon opening, as illustrated in FIG. 8. The coplanar-opening embodiment of FIG. 7 is achieved by providing the spur gear 70 in a rectangular form with the spur-gear teeth 82 parallel to each other. The spur-gear shaft 72 and the wing pivots 46 are parallel to each other. The dihedral-opening embodiment of FIG. 8 is achieved by providing the wing teeth 66 and/or the spur gear 70 in a beveled form, by angularly offsetting the spur-gear shaft 72 and the wing pivots 46 by the angle of the bevel and thence the angle A of the dihedral, and by driving the movement with a flexible shaft.

Figure 9:
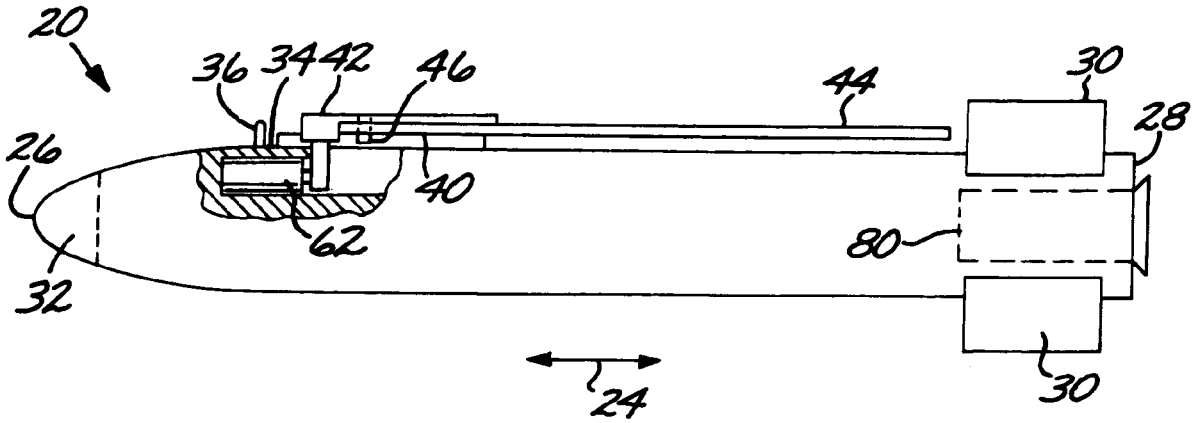
FIG. 9 is a schematic side elevational view of a second embodiment of the winged vehicle using the present approach, with some internal features shown in phantom view.

FIG. 9 illustrates a second embodiment of the winged vehicle 20, wherein elements common with the embodiments of FIGS. 1–6 are assigned the same reference numerals, and the prior discussion is incorporated. In the embodiment of FIG. 9, there is additionally a propulsion system 80. In this case, the propulsion system is in the form of a small solid rocket motor, but it may be a jet engine or other operable propulsion system. The winged vehicle 20 in this case may be a guided missile or a guided bomb that has a propulsive assist. A different drive motor configuration is used, with the drive motor being a pneumatic actuation mechanism with a cylinder and extendable drive piston that engages the wing-support body 42, and which as illustrated is positioned forward of the wing-support body 42. The nose 26 is also of a more aerodynamic shape than the generally hemispherical nose of FIGS. 1–4. These variations may be used singly or together, and in any operably combination with the features of the FIGS. 1–8 embodiments.

In the embodiments of FIGS. 1–6 and 9, a single drive motor 62 is used both to drive the wing-support body 42 along the tracks 40, and also to open and close the wings 44 via the rack-and-pinion mechanism. This approach uses only a single drive motor to reduce weight, but it also limits the relation of the sweep of the wings 44 (i.e., how far the wings have opened from the fully stowed position toward the fully deployed position) and the forward-aft position of the wing-support body 42 to a preselected relation. If it is desired to have the ability to set the wing sweep independently of the forward-aft position of the wing-support body 42, the movement of these two components may be decoupled so that they are separately movable.

Figure 10:
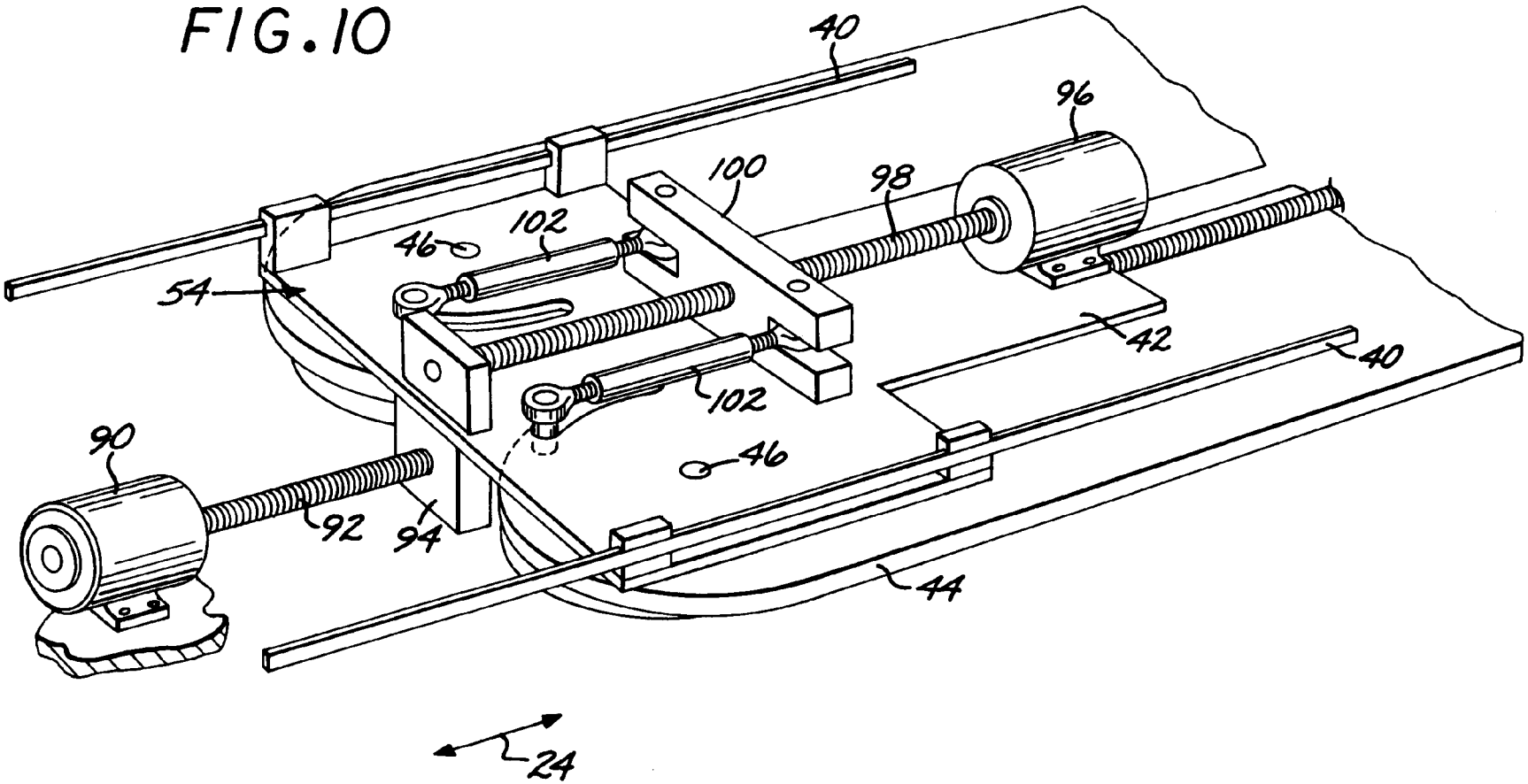
FIG. 10 is a schematic side elevational view of a third embodiment of the wing mechanism.

FIG. 10 illustrates another embodiment of the wing mechanism 38 that achieves this decoupled movement. In FIG. 10, elements common with the embodiments of FIGS. 1–9 are assigned the same reference numerals, and the prior discussion is incorporated. In the approach of FIG. 10, the actuation mechanism 54 includes two drives, a first drive that moves the wing-support body along the wing-support-body track, and a second drive that controllably moves the two deployable cantilevered wings between the stowed position and the deployed position. In the illustrated embodiment, a first drive motor 90 drives the wing-support body 42 in the fore-aft direction parallel to the direction of elongation 24, by driving a first leadscrew 92 engaging a first leadscrew follower 94 on the wing-support body 42. A second drive motor 96 is supported on and rides on the wing-support body 42, along with the wings 44 affixed to the wing-support body 42 by the pivots 46. The second drive motor 96 drives a second leadscrew 98 that engages a second leadscrew follower 100. (Other types of drives may be used as well, such as pneumatic drives, gas drives, or spring drives. The two drives may be of the same or different types.) A pair of bell crank arms 102 extend from the second leadscrew follower 100 to a respective off-pivot attachment 104 on each of the wings 44. As the second leadscrew follower 100 moves parallel to the direction of elongation 24, it opens or closes the two wings 44 in a coordinated fashion. The two drive motors 90 are operated independently of each other, so that the wings 44 may be opened independently of the movement of the center of lift parallel to the direction of elongation 24 by movement of the wing-support body 42. The controller 32 (FIG. 3) controls the two drive motors 90 and 96 independently of each other. This independent operation allows more control of the aerodynamics of the winged vehicle 20 than the single-motor approach of FIGS. 1–6 and 9, at a cost of greater weight. These approach of FIG. 10 may be used with other compatible features of the FIGS. 1–9 embodiments. In an alternative form, the structure of FIG. 10 may be used with a single drive motor, and the wing support body 42 and bell crank arms 102 linked together by a gear or other linkage. The relative rate of movement of the wing support body 42 and the opening of the wings 44 is then established by the gear ratio of the linkage gear.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A winged vehicle comprising an elongated fuselage;

a wing mechanism affixed to the fuselage and comprising a wing-support-body track affixed to and extending lengthwise along the fuselage, a translating wing-support body engaged to and translatable along the wing-support-body track, exactly two deployable cantilevered wings, each deployable cantilevered wing having a wing pivot mounted to the translating wing-support body so that the deployable cantilevered wing is pivotable about the translating wing-support body, wherein the two deployable cantilevered wings are each pivotable between a stowed position wherein the deployable cantilevered wings lie relatively close to the fuselage when the translating wing-support body is in a first position along the wing-support-body track, and a deployed position wherein the deployable cantilevered wings extend relatively outwardly from the fuselage when the translating wing-support body is in a second position along the wing-support-body track; and an actuation mechanism operable to controllably move the translating wing-support body along the wing-support-body track and to controllably move the two deployable cantilevered wings between the stowed position and the deployed position, wherein the actuation mechanism comprises a leadscrew and a leadscrew follower, and further comprises a gear structure that pivots the cantilevered wings.

2. The winged vehicle of claim 1, wherein the deployable cantilevered wings pivot about their respective wing pivots in linkage with a movement of the translating wing-support body.

3. The winged vehicle of claim 1, wherein the gear structure pivots the cantilevered wings responsive to the movement of the translating wing-support body.

4. The winged vehicle of claim 1, wherein the deployable cantilevered wings pivot about their respective wing pivots independently of a movement of the translating wing-support body.

5. The winged vehicle of claim 1, wherein the actuation mechanism includes a drive selected from the group consisting of an electromechanical drive motor, a pneumatic drive, a gas drive, and a spring drive.

6. The winged vehicle of claim 1, wherein the actuation mechanism comprises an electromechanical actuation mechanism.

7. The winged vehicle of claim 1, wherein the fuselage has a nose and a tail, and wherein the first position is closer to the nose than is the second position.

8. The winged vehicle of claim 1, wherein the winged vehicle further includes an attachment structure operable to attach the winged vehicle to a launcher.

9. The winged vehicle of claim 1, wherein the winged vehicle has no propulsion system.

10. The winged vehicle of claim 1, wherein the winged vehicle is a glide bomb.

11. The winged vehicle of claim 1, wherein the winged vehicle further includes a propulsion system.

12. The winged vehicle of claim 1, wherein the winged vehicle is a guided missile.

13. The winged vehicle of claim 1, wherein the winged vehicle further includes a movable guidance surface extending from the fuselage.

14. The winged vehicle of claim 1, further including a controller within the fuselage.

15. A winged vehicle comprising an elongated fuselage;

a wing mechanism affixed to the fuselage and comprising a wing-support-body track affixed to and extending lengthwise along the fuselage, a translating wing-support body engaged to and translatable along the wing-support-body track, exactly two deployable cantilevered wings, each deployable cantilevered wing having a wing pivot mounted to the translating wing-support body so that the deployable cantilevered wing is pivotable about the translating wing-support body, wherein the cantilevered wings are supported only from the respective wing pivots mounted to the translating wing support body, and wherein the two deployable cantilevered wings are each pivotable between a stowed position wherein the deployable cantilevered wings lie relatively close to the fuselage when the translating wing-support body is in a first position along the wing-support-body track, and a deployed position wherein the deployable cantilevered wings extend relatively outwardly from the fuselage when the translating wing-support body is in a second position along the wing-support-body track; and an actuation mechanism operable to controllably move the translating wing-support body along the wing-support-body track, the actuation mechanism comprising a leadscrew operable between the fuselage and the translating wing-support body, an electromechanical drive motor that turns the leadscrew, and a pivot mechanism whose turning produces a pivoting movement of the deployable cantilevered wings about their respective wing pivots relative to the translating wing-support body, wherein the pivot mechanism is indirectly turned by the leadscrew.

16. The winged vehicle of claim 15, wherein the fuselage has a nose and a tail, and wherein the first position is closer to the nose than is the second position.

17. The winged vehicle of claim 15, wherein the winged vehicle further includes a movable guidance surface extending from the fuselage.

18. The winged vehicle of claim 17, further including a controller within the fuselage and operable to control the movement of the movable guidance surface.

19. The winged vehicle of claim 15, wherein the winged vehicle is a glide bomb.

20. A winged vehicle comprising an elongated fuselage;

a wing mechanism affixed to the fuselage and comprising a wing-support-body track affixed to and extending lengthwise along the fuselage, a translating wing-support body engaged to and translatable along the wing-support-body track, exactly two deployable cantilevered wings, each deployable cantilevered wing having a wing pivot mounted to the translating wing-support body so that the deployable cantilevered wing is pivotable about the translating wing-support body, wherein the two deployable cantilevered wings are each pivotable between a stowed position wherein the deployable cantilevered wings lie relatively close to the fuselage when the translating wing-support body is in a first position along the wing-support-body track, and a deployed position wherein the deployable cantilevered wings extend relatively outwardly from the fuselage when the translating wing-support body is in a second position along the wing-support-body track; and an actuation mechanism operable to controllably move the translating wing-support body along the wing-support-body track and to controllably move the two deployable cantilevered wings between the stowed position and the deployed position, the actuation mechanism comprising a first drive comprising a first actuator that moves the wing-support body along the wing-support-body track, and a second drive comprising a second actuator that controllably moves the two deployable cantilevered wings between the stowed position and the deployed position independently of the movement of the wing-support body.

* * * * *